US009689570B2

(12) United States Patent
Kobayashi

(10) Patent No.: US 9,689,570 B2
(45) Date of Patent: Jun. 27, 2017

(54) HEATER AND GLOW PLUG WITH THE SAME

(71) Applicant: KYOCERA Corporation, Kyoto-shi, Kyoto (JP)

(72) Inventor: Akio Kobayashi, Kyoto (JP)

(73) Assignee: Kyocera Corporation, Kyoto (JP)

( * ) Notice: Subject to any disclaimer, the term of this patent is extended or adjusted under 35 U.S.C. 154(b) by 400 days.

(21) Appl. No.: 14/381,778

(22) PCT Filed: Feb. 28, 2013

(86) PCT No.: PCT/JP2013/055480
§ 371 (c)(1),
(2) Date: Aug. 28, 2014

(87) PCT Pub. No.: WO2013/129597
PCT Pub. Date: Sep. 6, 2013

(65) Prior Publication Data
US 2015/0048077 A1 Feb. 19, 2015

(30) Foreign Application Priority Data
Feb. 29, 2012 (JP) ..... 2012-043662

(51) Int. Cl.
*H05B 3/08* (2006.01)
*F23Q 7/00* (2006.01)
(Continued)

(52) U.S. Cl.
CPC ..... *F23Q 7/001* (2013.01); *H05B 3/12* (2013.01); *H05B 3/18* (2013.01); *H05B 2203/027* (2013.01)

(58) Field of Classification Search
CPC .. F23Q 7/001; G01N 27/4067; G01N 27/407; H05B 3/18; H05B 3/48; H05B 3/12; H05B 2203/027; Y10T 428/131
See application file for complete search history.

(56) References Cited

U.S. PATENT DOCUMENTS

| | | | |
|---|---|---|---|
| 6,274,855 | B1 | 8/2001 | Tatematsu et al. |
| 2009/0194519 | A1 | 8/2009 | Funaki et al. |
| 2011/0240625 | A1 | 10/2011 | Takenouchi |

FOREIGN PATENT DOCUMENTS

| | | | |
|---|---|---|---|
| EP | 0 874 534 | A2 | 10/1998 |
| EP | 0874534 | * | 10/1998 |

(Continued)

OTHER PUBLICATIONS

Extended European Search Report, European Patent Application No. 13755211.3, Oct. 30, 2015, 7 pgs.

(Continued)

*Primary Examiner* — Shawntina Fuqua
(74) *Attorney, Agent, or Firm* — Volpe and Koenig, P.C.

(57) ABSTRACT

The present invention relates to a heater including a heating element of which a main component is V, Nb, Ta, Mo, or W, leads bonded to respective ends of the heating element, and an insulating base in which the heating element and the lead are embedded, in which the heating element and the insulating base are formed of a sintered body which is integrally sintered, the heating element includes a compound including at least one of V, Nb, Ta, Cr, Mo, W, Mn, or Fe, which is an element different from the element used as the main component of the heating element, and the element is substantially not included around the heating element in the insulating base.

5 Claims, 1 Drawing Sheet

(51) Int. Cl.
*H05B 3/12* (2006.01)
*H05B 3/18* (2006.01)

(56) References Cited

FOREIGN PATENT DOCUMENTS

| | | | | |
|---|---|---|---|---|
| EP | 1 003 351 | A2 | | 5/2000 |
| EP | 1003351 | | * | 5/2004 |
| JP | 10-300084 | A | | 11/1998 |
| JP | 2000-156275 | A | | 6/2000 |
| JP | 2004-296337 | A | | 10/2004 |
| JP | 2007-335397 | A | | 12/2007 |
| JP | 2008-293804 | A | | 12/2008 |
| JP | 2010-080257 | A | | 4/2010 |

OTHER PUBLICATIONS

Extended European Search Report, European Patent Application No. 13755211.3, Oct. 15, 2015, 7 pgs.
Japanese Office Action (Decision of Refusal) with English concise explanation, Japanese Patent Application No. 2014-502379, Sep. 1, 2015, 5 pgs.
International Search Report, PCT/JP2013/055480, Mar. 28, 2013, 1 pg.

* cited by examiner

HEATER AND GLOW PLUG WITH THE SAME

TECHNICAL FIELD

The present invention relates to a heater used as, for example, a heater for ignition or flame detection in a combustion type vehicle heating system, a heater for ignition of various combustion equipment, such as an oil fan heater, a heater for a glow plug of an automobile engine, a heater for various sensors such as an oxygen sensor, a heater for heating of measurement equipment, and the like, and a glow plug including the same.

BACKGROUND ART

A heater used, for example, in a glow plug of an automobile engine includes a heating element, leads bonded to respective end portions of the heating element, and an insulating base in which the heating element and the leads are embedded. In addition, a compound of various metals is added as an additive to the heating element. The additive serves as an adjustment component for changing a temperature coefficient of resistance (for example, see Japanese Unexamined Patent Application Publication No. 2000-156275).

In recent years, there is a tendency that exhaust gas regulation and fuel efficiency regulation on diesel engine have been strengthened every year, and high temperature and high pressure at the time of combustion is required. Accordingly, the glow plug used at high temperatures is also progressed.

Here, the compound of various metals added as an adjustment component to the heating element diffuses into the insulating base side at the time of firing. In addition, when used at high temperatures, the compound diffused into the insulating base is ionized and transferred to the heating element of the cathode side, and therefore, there is a problem in that a resistance value of the heating element changes.

The present invention has been developed in light of the above circumstances, and an object thereof is to provide a heater, capable of suppressing the change in the resistance value of the heating element even when being used at a high temperature and having high reliability, and a glow plug with the same.

SUMMARY OF INVENTION

The present invention relates to a heater including a heating element of which a main component is V, Nb, Ta, Mo, or W, leads bonded to respective end portions of the heating element, and an insulating base in which the heating element and the leads are embedded, in which the heating element and the insulating base are formed of a sintered body, the heating element includes a compound including at least one of V, Nb, Ta, Cr, Mo, W, Mn, and Fe, which is an element different from the element used as the main component of the heating element, and the element is substantially not included around the heating element in the insulating base.

In addition, the present invention relates to a glow plug including the heater configured as described above and a metal holding member for holding the heater by being electrically connected to one of the pair of leads through an electrode lead-out portion.

DESCRIPTION OF EMBODIMENTS

Hereafter, detailed description will be given of examples of an embodiment of a heater of the present invention with reference to drawings.

Figure 1:
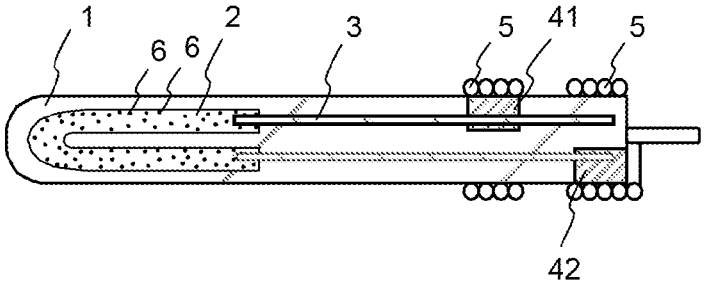
FIG. 1 is a schematic longitudinal sectional view illustrating an example of a heater according to an embodiment of the present invention.
Figure 2:
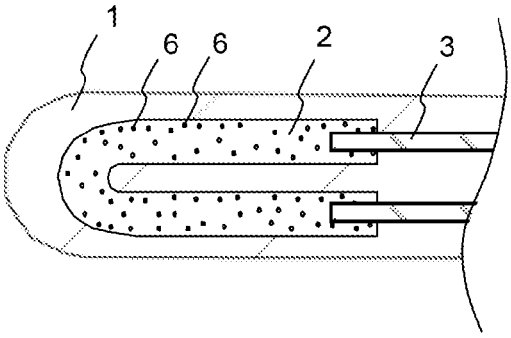
FIG. 2 is an enlarged longitudinal sectional view illustrating a main portion of the heater illustrated in FIG. 1.

FIG. 1 is a schematic longitudinal sectional view illustrating an example of the heater according to an embodiment of the present invention, and FIG. 2 is an enlarged longitudinal sectional view illustrating a main portion of the heater illustrated in FIG. 1.

The heater of the embodiment, as illustrated in FIG. 1 and FIG. 2, is a heater provided with a heating element 2 of which a main component is V, Nb, Ta, Mo, or W, leads 3 bonded to respective end portions of the heating element 2, and an insulating base 1 in which the heating element 2 and the leads 3 are embedded, in which the heating element 2 and the insulating base 1 are formed of a sintered body, the heating element 2 includes a compound 6 including at least one of V, Nb, Ta, Cr, Mo, W, Mn, and Fe, which is an element different from the element used as the main component of the heating element 2, and V, Nb, Ta, Cr, Mo, W, Mn, or Fe constituting the compound 6 is substantially not included around the heating element 2 in the insulating base 1.

The insulating base 1 in the heater of the embodiment, for example, is formed in a rod shape or a plate shape. The heating element 2 and a pair of leads 3 are embedded in the insulating base 1. Here, the insulating base 1 is formed of a ceramic sintered body, and accordingly, it is possible to provide a heater with high reliability at the time of rapid temperature rise. As the ceramic sintered body, ceramics having electrical insulating properties such as oxide ceramics, nitride ceramics, and carbide ceramics can be exemplified. Specifically, as the ceramic sintered body, alumina ceramics, silicon nitride ceramics, aluminum nitride ceramics, silicon carbide ceramics, or the like can be used. In particular, the ceramic sintered body is preferably the silicon nitride ceramics. This is because the silicon nitride which is a main component of the silicon nitride ceramics is good from the viewpoint of high strength, high toughness, high insulation, and heat resistance.

For example, the insulating base 1 formed of silicon nitride ceramics can be obtained according to a method in which, with respect to silicon nitride which is a main component, rare earth element oxides such as $Y_2O_3$, $Yb_2O_3$, or $Er_2O_3$ of 5% by mass to 15% by mass as a sintering additive, $Al_2O_3$ of 0.5% by mass to 5% by mass, and $SiO_2$ are mixed such that the amount of $SiO_2$ included in the sintered body becomes 1.5% by mass to 5% by mass, the mixture is molded into a predetermined shape, and hot-press-fired at 1650° C. to 1780° C.

The length of the insulating base 1 is, for example, set to 20 mm to 50 mm, and the diameter of the insulating base 1, for example, is set to 3 mm to 5 mm. Moreover, in a case of using a base formed of silicon nitride ceramics as the insulating base 1, it is preferable to disperse a mixture of $MoSi_2$, $WSi_2$, or the like in the insulating base 1 by mixing $MoSi_2$, $WSi_2$, or the like in the raw material. In this case, since it is possible to cause a thermal expansion coefficient of silicon nitride ceramics which is a base material to be close to a thermal expansion coefficient of the heating element 2 and reduce thermal stress due to heating of the heating element 2, it is possible to improve durability of the heater.

The heating element 2 embedded in the insulating base 1 has, for example, a folded shape in the shape of a longitudinal sectional surface, and the vicinity of the center (around the midpoint of the turn) of the folded shape located at the front end is a heating portion that generates the most heat. The heating element 2 is embedded in the top end side of the insulating base 1, and a distance from the front end of the heating element 2 (around the center of the folded shape) to the rear end of the heating element 2, for example, is set to 2 mm to 10 mm. Moreover, the shape of the cross-sectional surface of the heating element 2 may be any shape out of a circular, an oval, or a rectangular shape.

The heating element 2 is formed of a sintered body obtained by firing a conductive paste. As the conductive paste, a conductive paste of which a main component is a refractory metal such as V, Nb, Ta, Mo, W, or Cr, or the compounds thereof can be exemplified. In a refractory metal selected from the group consisting of V, Nb, Ta, Mo, and W, or the compound thereof, as described below, a compound 6 of V, Nb, Ta, Cr, Mo, W, Mn, or Fe is more likely to be dissolved, and an element (V, Nb, Ta, Cr, Mo, W, Mn, or Fe) of the compound 6 is unlikely to diffuse to the insulating base 1 side during firing. In addition, the heating element 2 may include a material for forming the insulating base 1 to adjust the thermal expansion coefficient. By including a ceramic material for forming the insulating base 1 in the heating element 2, it is possible to cause the thermal expansion coefficient of the heating element 2 to be close to the thermal expansion coefficient of the insulating base 1.

In addition, it is considered that the reason why the compound 6 of V, Nb, Ta, Cr, Mo, W, Mn, or Fe is likely to be dissolved when the main component of the heating element 2 is V, Nb, Ta, Mo, W, or Cr is that the main components of the heating element 2 and the compound 6 have the same crystal structure. Specifically, both the crystal structure of the main component of the heating element 2 described above and the crystal structure of the main component of the compound 6 described above are a body-centered cubic structure, and therefore, it is considered that both are likely to be dissolved due to the same crystal structure.

The pair of the leads 3 connected to the heating element 2 embedded in the insulating base 1 may be configured with a metal lead wire of W, Mo, Re, Ta, or Nb, or may be formed by printing a conductive paste in the same manner as in the heating element 2. Further, resistance per unit length of the leads 3 is lower than that of the heating element 2.

In addition, a first electrode lead-out portion 41 is embedded in the insulating base 1, one end of the first electrode lead-out portion 41 is connected to one of the pair of the leads 3, and another end thereof is lead out to the side surface of the insulating base 1. On the other hand, a second electrode lead-out portion 42 is embedded in the insulating base 1, one end of the second electrode lead-out portion 42 is connected to another of the pair of the leads 3, and another end thereof is lead out to the side surface of the insulating base 1.

Both the first electrode lead-out portion 41 and the second electrode lead-out portion 42 are formed of the same material as the heating element 2, and the resistance per unit length is lower than that of the heating element 2 so as to suppress unnecessary heating. In other words, since the heating element 2 has higher resistance than the leads 3, the first electrode lead-out portion 41, and the second electrode lead-out portion 42, heating is reliably performed by the heating element 2, whereby a high temperature is obtained.

The heater of the embodiment is configured in such a manner that the compound 6 of V, Nb, Ta, Cr, Mo, W, Mn, or Fe different from the element used as the main component of the heating element 2 is included in the heating element 2, and the element (V, Nb, Ta, Cr, Mo, W, Mn, or Fe) of the compound 6 is substantially not included around the heating element 2 in the insulating base 1.

Here, the compound 6 including elements (V, Nb, Ta, Cr, Mo, W, Mn, or Fe) different from the element used as the main component of the heating element 2 is an adjustment component for changing a temperature coefficient of resistance of the heating element 2. By adding the compound 6 in the conductive paste for forming the heating element 2 and firing, it is possible to obtain the heating element 2 having a desirable temperature coefficient of resistance after firing, and it is possible to manufacture a heater including the heating element 2 having a desired resistance value.

Moreover, in the conductive paste for forming the heating element 2, ceramics is added so as to cause the thermal expansion coefficient of the heating element 2 to be close to that of the insulating base 1, and a sintering additive component added thereto is significantly reduced. By doing so, it is possible to shorten the sintering timing of ceramics in the insulating base 1, to slow down the sintering timing of ceramics in the heating element 2, and to shift the timing of liquid phase production. Thus, it is possible to prevent the element (V, Nb, Ta, Cr, Mo, W, Mn, or Fe) of the compound 6 from diffusing from the heating element 2 into the insulating base 1. That is, by first, sintering the insulating base 1 side, and then sintering the heating element 2 side, contraction of the insulating base 1 starts, and then the heating element 2 starts sintering while receiving force of compression. Therefore, since the contraction by sintering occurs toward the inside (heating element 2 side) direction, movement of the liquid phase also proceeds in the inside (heating element 2 side) direction, and it is possible to confine the element (V, Nb, Ta, Cr, Mo, W, Mn, or Fe) of the compound 6 in the heating element 2. Therefore, the element (V, Nb, Ta, Cr, Mo, W, Mn, or Fe) of the compound 6 is substantially not included around the heating element 2 in the insulating base 1.

Moreover, "a sintering additive component is significantly reduced" described here, specifically, for example, means that the sintering additive component added to ceramics in the heating element 2 is made to be ½ or less of the sintering additive component added to the insulating base 1. Preferably, the sintering additive component to be added to ceramics in the heating element 2 is preferably ⅓ or less of the sintering additive component added to the insulating base 1. In the related art, the sintering additive component added to ceramics in the heating element is generally set to about 3% by mass or greater and less than 15% by mass. For example, in PTL 1, the sintering additive component is set to 2% by mass or greater and less than 10% by mass. In contrast, as one example of amount of the sintering additive component added to ceramics in the heating element 2 of the present invention, for example, the amount is set to about 0.05% by mass or greater and less than 0.2% by mass.

In the present invention, by significantly reducing the content of the sintering additive component in the heating element 2, diffusion of the element (V, Nb, Ta, Cr, Mo, W, Mn, or Fe) of the compound 6 from the heating element 2 to the insulating base 1 was suppressed.

In addition, "substantially not included" described here means that the element (V, Nb, Ta, Cr, Mo, W, Mn, or Fe) of the compound 6 is present at only a proportion of 1 ppm or less in the insulating base 1 around the heating element 2, or is not present at all.

Furthermore, "around the heating element 2" described here means that the distance from the heating element 2 is within the range of 100 μm. This is because in a case where the element (V, Nb, Ta, Cr, Mo, W, Mn, or Fe) of the compound 6 is present in the insulating base 1 within the range of 100 μm from the heating element 2, there is a possibility that during ionization, these elements are transferred to the cathode side of the heating element 2, and therefore the resistance value of the heating element 2 changes. Therefore, since these elements are hardly transferred to the heating element 2 even if the element (V, Nb, Ta, Cr, Mo, W, Mn, or Fe) of the compound 6 is present in the insulating base 1 at a position away 100 μm or greater from the heating element 2, there is no particular problem even if the element (V, Nb, Ta, Cr, Mo, W, Mn, or Fe) of the compound 6 was present in the insulating base 1 at a position away 100 μm or greater.

The proportion of the element (V, Nb, Ta, Cr, Mo, W, Mn, or Fe) of the compound 6 in the insulating base 1 around the heating element 2 can be confirmed according to the following method. Specifically, 0.1 mg of the insulating base 1 in a region in the range of 100 μm from the heating element 2 is cut, followed by crushing, and the resultant product is dissolved using 1 ml of hydrofluoric acid and 5 ml of nitric acid. Quantitative analysis of the element (V, Nb, Ta, Cr, Mo, W, Mn, or Fe) of the compound 6 is performed on the solution obtained in this manner using an ICP mass spectrometry apparatus (manufactured by Micromass Inc.). By this, it is possible to confirm the presence proportion of the elements of the compound 6.

As the compound 6 including at least one of elements of V, Nb, Ta, Cr, Mo, W, Mn, and Fe different from the element used as the main component of the heating element 2, carbide, nitride, silicide, or oxide of V, Nb, Ta, Cr, Mo, W, Mn, or Fe can be exemplified. Moreover, carbide, nitride, silicide, or oxide of V, Nb, Ta, Mo, or W which is a suitable element as the main component of the heating element 2 is included in the exemplification above, and this means that, for example, in a case where the main component of the heating element 2 is V, it is possible to use carbide, nitride, silicide, or oxide of the elements other than V as the compound 6.

The compound 6 is likely to be dissolved to the main component of the heating element 2, and the element (V, Nb, Ta, Cr, Mo, W, Mn, or Fe) of the compound 6 is unlikely to diffuse to the insulating base 1 during firing. Thus, it is possible to suppress the phenomenon that, even when using at high temperatures, the compound is ionized and transferred to the heating element 2 of the cathode side, and therefore, the resistance value of the heating element 2 changes.

Moreover, when using at a high temperature, the additive component included in the insulating base 1 around the heating element 2 is cationized, and the compound ionized is unlikely to enter the insulating base 1 around the heating element 2. Therefore, the compound is not transferred to the cathode side through the insulating base 1 from the anode side, and there is little change in the resistance value due to this.

Furthermore, the compound 6 may be a Cr compound. Since the Cr compound completely dissolved with a refractory metal selected from the group consisting of V, Nb, Ta, Mo, and W or the compound thereof, the element (V, Nb, Ta, Cr, Mo, W, Mn, or Fe) of the compound 6 is more unlikely to diffuse to the insulating base 1 during firing. When Cr is present in the grain boundary of the ceramics configuring the insulating base 1 and the heating element 2, Cr is likely to be ionized, but when temporarily dissolving Cr in the heating element 2, Cr is unlikely to be ionized, Cr is not transferred to the cathode side of the heating element 2, and the resistance value of the heating element 2 does not change. In addition, Cr is suitable for mass production at low cost.

At that time, the content of Cr in the heating element 2 is preferably $1\times10^{-6}$% by mass to $1\times10^{-1}$% by mass. When the content is in the range, it is easy to change the temperature coefficient of resistance of the heating element 2, and the amount to be dissolved to the heating element 2 becomes sufficient.

As illustrated in FIG. 1, in the heater of the present invention, for example, connection fittings 5 are electrically connected to the end portions of the first electrode lead-out portion 41 and the second electrode lead-out portion 42 derived from the side surface of the insulating base 1, respectively. Then, the heater is connected to an external circuit by the connection fittings 5.

In addition, the above-described heater can also be used in a glow plug (not shown in the figure). That is, the glow plug (not shown in the figure) of the present invention includes a heater and a metal holding member (sheath fitting) for holding the heater electrically connected to one of the pair of leads 3 configuring the heater, through the first electrode lead-out portion 41, and by this configuration, since the change in the resistance value of the heating element is suppressed even when being used at high temperatures, it is possible to realize the glow plug having high reliability.

Figure 3:
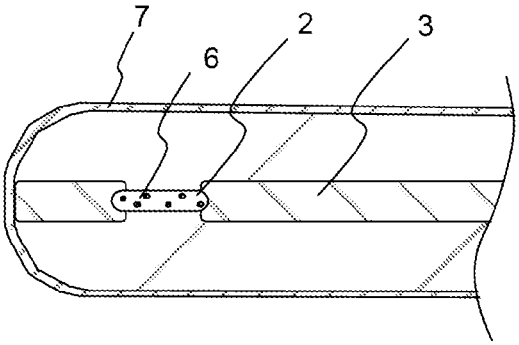
FIG. 3 is an enlarged longitudinal sectional view illustrating another example of a main portion of a heater according to an embodiment of the present invention.

The example illustrated in FIG. 2 is an example of the heating element 2 having a folded shape, and the heating element 2 is not limited to this shape. Examples of the heating element 2 not having a folded shape as illustrated in FIG. 3 are also included in the present invention. Moreover, the example illustrated in FIG. 3 is a configuration in which a conductor layer 6 is disposed on the surface of the insulating base 1, and the conductor layer 6 is provided so as to be electrically connected to the connection fitting or the metal holding member (sheath fitting).

A method of producing the heater of the embodiment will be described below.

First, sintering additive is added to ceramic powder of alumina ceramics, silicon nitride ceramics, aluminum nitride ceramics, silicon carbide ceramics, or the like, whereby ceramic powder which is a raw material of the insulating base 1 is manufactured.

Next, a molded body is manufactured by press-molding the ceramic powder, or after preparing ceramic slurry from the ceramic powder, the ceramic slurry is molded into a sheet shape, whereby a ceramic green sheet is manufactured. Here, the obtained molded body or ceramic green sheet becomes the insulating base 1 in the half state.

Next, patterns of the conductive paste for forming the heating element which becomes the heating element 2 and the conductive paste for forming the electrode lead-out portions which become the first electrode lead-out portion 41 and the second electrode lead-out portion 42 are printed on a half molded body or the ceramic green sheet, respectively, whereby printed molded bodies are obtained. Here, as the material of the conductive paste for forming the heating element and the conductive paste for forming the electrode lead-out portions, a material of which the main component is refractory metals such as V, Nb, Ta, Mo, or W is used. The conductive paste for forming the heating element and the conductive paste for forming electrode lead-out portions can be manufactured by combining a compound as an adjustment component including at least one of V, Nb, Ta, Cr, Mo, W, Mn, or Fe different from the element used as the main component of the conductive paste for forming the heating element and the conductive paste for forming electrode lead-out portions in these refractory metals, the ceramic powder, a binder, and an organic solvent and kneading. By adding the ceramic powder of the same material as the insulating base 1 in the conductive paste for forming the heating element, it is possible to cause the thermal expansion coefficient of the heating element 2 to be close to the thermal expansion coefficient of the insulating base 1.

At that time, by changing the length and line width of the patterns of the conductive paste for forming the heating element and the conductive paste for forming electrode lead-out portions, the length or the interval of the folded pattern, or the like depending on the use of the heater, the heating position and the resistance value of the heating element 2 are set to a desired value.

On the other hand, a lead molded body in which the lead 3 is embedded so as to be positioned between the heating element 2 and the electrode lead-out portions (the first electrode lead-out portion 41 and the second electrode lead-out portion 42) on another half molded body or the ceramic green sheet is obtained. As the lead 3, a metal lead wire of W, Mo, Re, Ta, or Nb may be used, and may be formed by printing the conductive paste.

By overlapping the obtained printed molded body and the lead molded body, a molded body in which patterns of the conductive paste for forming the heating element, the lead 3, and the conductive paste for forming electrode lead-out portions are formed is obtained.

Next, it is possible to manufacture a heater by firing the obtained molded body at 1500° C. to 1800° C. Moreover, firing is preferably performed in an inert gas atmosphere or a reductive atmosphere. In addition, firing is preferably performed in a state where pressure is applied. Furthermore, since if continuously maintaining the maximum temperature during firing, after the contraction ends, the element (V, Nb, Ta, Cr, Mo, W, Mn, or Fe) of the compound 6 diffuses from the heating element 2 into the insulating base 1, and therefore, by preventing the diffusion by quenching immediately after the contraction ends, it is possible to obtain a heater as illustrated in FIG. 2.

Moreover, "quenching" described here, for example, means that cooling is performed at a temperature change of 200° C./h or greater. By cooling at a temperature change of 200° C./h or greater, it is possible to suppress the element (V, Nb, Ta, Cr, Mo, W, Mn, or Fe) of the compound 6 from diffusing from the heating element 2 into the insulating base 1.

EXAMPLES

The heater in examples of the present invention was manufactured in the following manner.

First, 85% by mass of silicon nitride powder as a raw material of the insulating base, 10% by mass of $Yb_2O_3$ powder as the sintering additive, 3.5% by mass of $MoSi_2$ powder, 1.5% by mass of aluminum oxide powder were mixed, whereby raw material powder was manufactured. Thereafter, a molded body in the half state which becomes the insulating base by press-molding using the raw material powder was manufactured.

Next, 29.95% by mass of silicon nitride powder and 0.05% by mass of a metal compound $Cr_3C_2$ as an additive were mixed with 70% by mass of tungsten carbide (WC) powder, and a suitable organic solvent and a solvent were added to the mixture, whereby a conductive paste which becomes the heating element, the first electrode lead-out portion, and the second electrode lead-out portion was manufactured. Here, 0.1% by mass of $Yb_2O_3$ powder as the sintering additive was mixed with the silicon nitride powder which is mixed (WC) with tungsten carbide (WC) powder.

Next, the conductive paste was coated on the surface of the molded body of the half state which becomes the insulating base in the shape of the heating element 2 illustrated in FIG. 2 by a screen printing method.

Next, another molded body in the half state was manufactured which becomes the insulating base with a W lead pin embedded such that the W lead pin which the main component is tungsten is positioned between the heating element and the electrode lead portion when respective molded bodies in the half state described above are overlapped and pressed. Then, by overlapping the two molded bodies, a molded body having the heating element, the lead, and the electrode lead-out portion in the insulating base was obtained.

Next, after the obtained molded body was placed in a mold made of carbon in a cylindrical shape, hot press firing was performed at the temperature of 1700° C. and the pressure of 35 MPa in a reductive atmosphere, and the resultant product was sintered to manufacture a heater (sample 1). Here, the heater of the sample 1 was quenched in the temperature range of 1700° C. to 1300° C. at the cooling rate of 200° C./h or greater immediately after the firing contraction ends.

On the other hand, 28% by mass of silicon nitride powder and 2% by mass of a metal compound $Cr_3C_2$ as an additive were mixed with 70% by mass of tungsten carbide (WC) powder, and a suitable organic solvent and a solvent were added to the mixture, whereby the conductive paste which becomes the heating element, the first electrode lead-out portion, and the second electrode lead-out portion was manufactured. Here, the silicon nitride powder which is mixed (WC) with tungsten carbide (WC) powder mixed with 15% by mass of $Yb_2O_3$ powder as the sintering additive was prepared, the mixture was fired to manufacture a heater (sample 2) in the temperature range of 1700° C. to 1300° C. at the cooling rate of 50° C./h without quenching immediately after the firing contraction ends, and other conditions were the same as in the above-described heater.

Furthermore, a heater (sample 3) manufactured at a cooling rate of 100° C./h and a heater (sample 4) manufactured at a cooling rate of 180° C./h were prepared. Conditions other than the cooling rate of the samples 2, 3, and 4 described above are the same as those of the sample 1.

Next, the obtained heater was polishing-processed in a cylindrical shape of $\phi$ 4 mm with a full length of 40 mm, and a connection fitting made of Ni in a coil shape was brazed to the electrode lead-out portion exposed on the surface.

Then, a voltage is applied to the heater of each prepared sample to make the temperature be 1500° C. and intermittent energization was performed. Specifically, 10,000 cycles of intermittent energization, in which one cycle means that energization is continued at 1500° C.±25° C. for 1 minute, energization is stopped for 1 minute, and air cooling is performed, were performed. By comparing the initial resistance value and the resistance value after 10,000 cycles, a comparison of the resistance change rates of the heating element 2 was performed. Moreover, for the resistance change, the front end of the heater was immersed in a thermostat of 25° C., stabilized at 25° C., the initial resistance value and the resistance value after the tests were measured, and the resistance change rate between them was evaluated. Furthermore, quantitative analysis of the element Cr was performed in the above-described method using an ICP mass spectrometry apparatus.

The above results were summarized in Table 1.

TABLE 1

| | Content of Cr | Resistance change rate | Cooling rate |
|---|---|---|---|
| Sample 1 | less than 1 ppm | 0.01% | 200° C./h |
| Sample 2 | 0.05% | 12% | 50° C./h |
| Sample 3 | 0.02% | 5% | 100° C./h |
| Sample 4 | 0.01% | 0.50% | 180° C./h |

As can be seen from the results illustrated in Table 1, in the heater of the sample 2 as a comparative example, the element Cr diffused by about 0.05% in the range of 100 μm from the heating element, and the resistance change rate after 10,000 cycles end was 12%. In addition, in the heater of the sample 3, the element Cr diffused by about 0.02% in the range of 100 μm from the heating element, and the resistance change rate after 10,000 cycles end was 5%. In addition, in the heater of the sample 4, the element Cr diffused by about 0.01% in the range of 100 μm from the heating element, and the resistance change rate after 10,000 cycles end was 0.5%.

In contrast, in the heater of the sample 1 as an example of the present invention, the element Cr which is present in the range of 100 μm from the heating element 2 was less than 1 ppm, and it was not possible to confirm the presence by the measurement method described above. In addition, the resistance change rate after 10,000 cycles end was 0.01%.

From the above results, it was confirmed that it is possible to suppress the change in the resistance value of the heating element by suppressing the diffusion of the element Cr.

REFERENCE SIGNS LIST

1: Insulating base
2: Heating element
3: Lead
41: First electrode lead-out portion
42: Second electrode lead-out portion
5: Connection fitting
6: Compound
7: Conductive layer

The invention claimed is:

1. A heater, comprising:

a heating element that includes a first element selected from the group consisting of V,Nb, Ta, Mo, and W;

a pair of leads bonded to respective end portions of the heating element; and an insulating base in which the heating element and the leads are embedded;

wherein the heating element and the insulating base are formed of a sintered body which is integrally sintered;

wherein the heating element further includes a compound including one or more second elements selected from the group consisting of V, Nb, Ta, Cr, Mo, W, Mn, and Fe, wherein the one or more second elements are selected so that the one or more second elements are different from the first element; and wherein the one or more second elements are present in the insulating base at a proportion of 1 ppm or less at a distance of 100 μm from the heating element.

2. The heater according to claim 1, wherein the element is Cr.

3. The heater according to claim 2, wherein a content of Cr in the heating element is $1\times10^{-6}$% by mass to $1\times10^{-1}$% by mass.

4. A glow plug, comprising:

the heater according to claim 1; and a metal holding member for holding the heater by being electrically connected to one lead of the pair of leads through an electrode lead-out portion.

5. The heater according to claim 1, wherein the one or more second elements are present at a proportion of 0 ppm at a distance of 100 μm from the heating element.

* * * * *